US007658370B2

(12) United States Patent
Rotzler et al.

(10) Patent No.: US 7,658,370 B2
(45) Date of Patent: Feb. 9, 2010

(54) ROPE WINCH

(75) Inventors: Jürgen Rotzler, Steinen (DE); Steffen Walz, Lörrach (DE)

(73) Assignee: Rotzler GmbH & Co. KG, Steinen (DE)

( * ) Notice: Subject to any disclaimer, the term of this patent is extended or adjusted under 35 U.S.C. 154(b) by 5 days.

(21) Appl. No.: 11/848,299

(22) Filed: Aug. 31, 2007

(65) Prior Publication Data

US 2008/0054237 A1 Mar. 6, 2008

(30) Foreign Application Priority Data

Aug. 31, 2006 (EP) ..... 06018165

(51) Int. Cl.
*B66D 1/22* (2006.01)

(52) U.S. Cl. ..... 254/344; 254/274; 254/342

(58) Field of Classification Search ..... 254/274, 254/275, 278, 342, 344
See application file for complete search history.

(56) References Cited

U.S. PATENT DOCUMENTS

| | | | | |
|---|---|---|---|---|
| 3,330,154 | A | 7/1967 | Habern | |
| 5,284,325 | A * | 2/1994 | Sasaki et al. | 254/274 |
| 5,295,664 | A * | 3/1994 | Kamper | 254/220 |
| 6,655,662 | B2 * | 12/2003 | Kemppainen | 254/275 |
| 6,966,544 | B2 * | 11/2005 | McCormick et al. | 254/342 |
| 7,234,684 | B2 * | 6/2007 | Kohlenberg et al. | 254/274 |
| 7,389,972 | B2 * | 6/2008 | Mathias | 254/275 |
| 7,416,169 | B2 * | 8/2008 | Noeske et al. | 254/275 |
| 2005/0279976 | A1 | 12/2005 | Kohlenberg et al. | |
| 2007/0205405 | A1 * | 9/2007 | Stockmaster et al. | 254/275 |

FOREIGN PATENT DOCUMENTS

| | | | |
|---|---|---|---|
| DE | 8520140 | U1 | 8/1985 |
| DE | 19512103 | C2 | 6/1997 |
| DE | 29723821 | U1 | 3/1999 |
| EP | 1308414 | A1 | 5/2003 |

* cited by examiner

*Primary Examiner*—Emmanuel M Marcelo
(74) *Attorney, Agent, or Firm*—Gudrun E. Huckett

(57) ABSTRACT

A rope winch has at least one bearing support and a rope drum supported on the at least one bearing support so as to be rotatable about a drive axis. A drive motor and a gear connected to the drive motor are provided, wherein the drive motor drives the rope drum about the drive axis through the gear. At least one sensor that senses a load acting on the rope drum is provided. An exchangeably secured component that is exchangeable without dismounting the at least one bearing support is provided. The at least one sensor is arranged on the exchangeably secured component.

18 Claims, 2 Drawing Sheets

ROPE WINCH

BACKGROUND OF THE INVENTION

The invention relates to a rope winch comprising a rope drum that is mounted on at least one bearing support so as to be rotatable about a drive axis and can be driven by a drive motor and a gear about its drive axis, wherein the rope winch has at least one sensor for detecting the load on the rope drum.

German patent DE 195 12 103 C2 discloses a rope winch with a rope drum. For detecting the load on the rope drum, the rope winch is provided with torque sensors that are arranged in the interior of the rope drum on an outer circumference of a cup-shaped receptacle for the drive motor. In order to exchange the torque sensors, one of the bearing supports as well as the entire drive motor must be dismounted from the rope drum. This is very complicated so that repair or exchange of a torque sensor requires a high expenditure.

SUMMARY OF THE INVENTION

It is an object of the present invention to provide a rope winch of the aforementioned kind that enables a simple exchange and simple repair.

In accordance with the present invention, this is achieved in that the sensor for detecting the load is arranged on a component that is exchangeably secured on the rope winch without requiring dismounting of a bearing support.

Because the component on which the sensor for detecting the load is arranged is secured in an exchangeable way on the rope winch, the sensor can be simply exchanged by exchanging the component. The component is arranged in such a way that, without dismounting a bearing support, it is exchangeable. For exchanging it, the rope drum must not be opened so that the exchange can be performed in a simple way by the user himself. By making the component on which the sensor is arranged exchangeable, it is possible in a simple way to retrofit a rope winch with a sensor for detecting the load. Also, rope winches with devices for load detection and rope winches without load detection devices can be constructed in the same way. Only the component on which the sensor is arranged must be matched or adapted and optionally provided with a sensor. Because the sensor is not arranged on a bearing support, deformations of the bearing support do not affect the measurement of the load so that a more precise measuring result can be obtained.

Advantageously, the component penetrates or extends through the bearing support. In this way, a simple exchangeability is provided. It is also provided that the sensor has a connecting line for connecting it to a control. The connecting line is guided out of the winch through a passage formed within the component. The connecting line is thus integrated into the component so that the exchange of the component together with the sensor can be carried out very simply and very quickly.

In order to ensure a simple exchangeability, it is provided that the position of the component on the bearing support is secured by securing means that are accessible from the exterior of the bearing support facing away from the rope drum.

Advantageously, the component is comprised of a material that is different from the material of the bearing support. The bearing support is comprised in particular of cast material, preferably gray cast iron. Bearing supports of gray cast iron can be produced in a simple way and withstand well the forces occurring in operation. However, gray cast iron is not well suited for arranging sensors for load detection thereon. The component can be made from a material that is suitable especially well for arranging sensors thereon, for example, steel. By arranging the sensor on a component that is separate from the bearing support, the material of the component can be matched to the requirements of the sensor.

Advantageously, the rope drum is supported with both ends in bearing supports. In this way, high stability and minimal bending forces result. In particular, on one of the bearing supports the drive motor is secured and on the opposite bearing support the gear is supported. It is provided that the gear is supported on the bearing support by means of the component on which the sensor for load detection is arranged. By means of the gear the forces acting on the rope drum are transmitted into the component so that the deformation of the component is a measure of the forces acting on the rope drum.

Advantageously, the component is a bolt. The gear is in particular a planetary gear whose planet wheels are supported on a stationary planet support. Advantageously, the planet support is fixedly connected to the bolt (no relative rotation is possible). The fixed connection is in particular designed such that it enables a movement of the bolt relative to the planet support in the direction of the drive axis of the rope drum. Accordingly, the bolt can be pulled out of the planet support in the direction of the drive axis. The planet support is secured in the rope drum by means of the planet wheels so that removal of the bolt is possible without problems. Advantageously, the planet support and the bolt are fixedly connected by means of a toothing, in particular, a serration, so that they cannot rotate relative to one another. A toothing enables the transmission of high torque and, at the same, insertion of the component into the planet support in the direction of the drive axis.

It is provided that the bolt is fixedly connected to the bearing support so that it cannot rotate relative to the bolt. The fixed connection is designed such that a movement of the bolt relative to the bearing support in the direction of the drive axis of the rope drum is possible. In this way, the bolt can be pulled out from the bearing support in the direction of the drive axis. By means of the fixed connection of the bolt with bearing support and planet support via a toothing, respectively, a simple exchangeability of the bolt is provided.

Advantageously, the bolt has a circumferential groove in which the sensor for detecting the load is arranged. The circumferential groove represents in particular the smallest cross-section of the bolt. At this location, the greatest deformations occur so that a sufficiently large measuring signal can be generated. Advantageously, the bolt is fixedly connected with a first section to the bearing support and with a second section fixedly connected to the planet support wherein the circumferential groove is arranged between the first and second sections. The circumferential groove in which the sensor is arranged is thus positioned in the area in which the torque is transmitted from the planet support to the bearing support. Advantageously, the sensor for detecting the load is a wire strain gauge. In particular, four such wire strain gauges are provided wherein two pairs of wire strain gauges are positioned opposite one another at the circumference of the circumferential groove. Two of the wire strain gauges of a pair are displaced by 90 degrees relative to one another, respectively, so that the strain signals are measured in directions that are perpendicular to one another.

DESCRIPTION OF THE PREFERRED EMBODIMENTS

Figure 1:
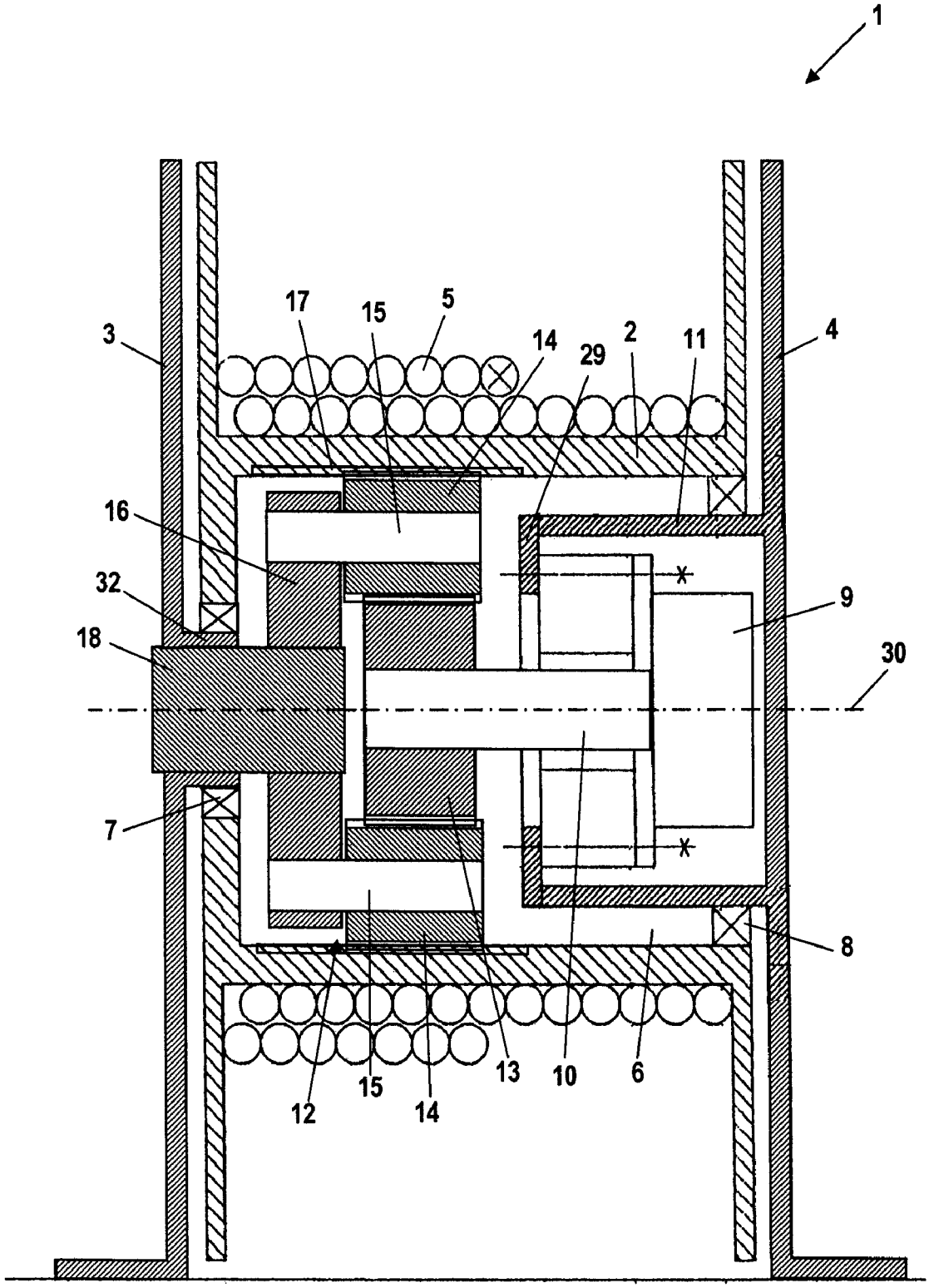
FIG. 1 is a schematic section illustration of a rope winch.
Figure 2:
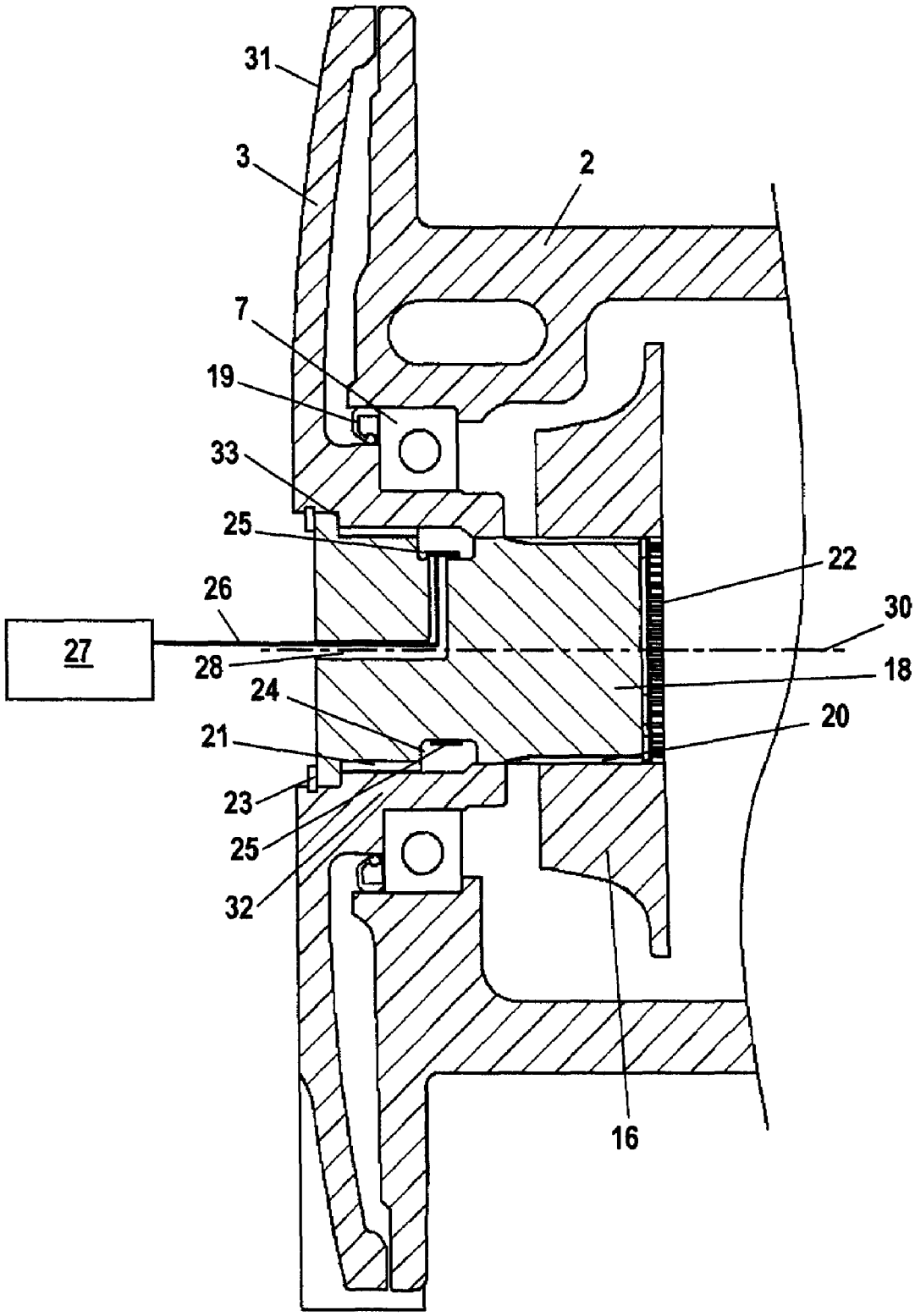
FIG. 2 is a detail section view of the rope winch according to FIG. 1.

The rope winch 1 illustrated in FIG. 1 has two bearing supports 3, 4 between which a rope drum 2 is arranged. The rope drum 2 is supported so as to be rotatable about drive axis 30. A rope 5 is wound onto the rope drum 2 and, upon rotation of the rope drum 2 about its drive axis 30, depending on the rotational direction, is wound onto or removed from the rope drum 2. The rope drum 2 is supported on the bearing support 3 by means of a bearing 7 that rests on a collar 32 of the bearing support 3 projecting into the rope drum 2. As shown in FIG. 2, a seal 19 is arranged on the side of the bearing 7 facing the bearing support 3. The interior 6 of the rope drum 2 is open in the direction toward the bearing support 4. A receiving cup 11 is formed on the bearing support 4 and projects into the interior 6 of the rope drum 2. At its outer circumference a bearing 8 is arranged on which the other end of the rope drum 2 is supported.

A drive motor 9 is arranged in the receiving cup 11 and drives in rotation the drive shaft 10. The receiving cup 11 is closed off partially by a plate 29. The drive motor 9 is connected by screws to the plate 29. The plate 29 has a central opening through which the drive shaft 10 projects.

The drive motor 9 drives the rope drum 2 by means of gear 12 that is configured as a planetary gear. The sun wheel 13 of the planetary gear is fixedly connected to the drive shaft 10 for common rotation. The sun wheel 13 drives the planet wheels 14; two of the planet wheels 14 are shown in FIG. 2. For example, four planet wheels 14 can be provided. The planet wheels 14 are fixedly arranged about the drive axis 32 relative to the bearing support 3. For this purpose, the planet wheels 14 are rotatably supported on bearing axles 15. The bearing axles 15 are secured on the planet support 16 that is fixedly connected to the bolt 18 such that planet support 16 and bolt 18 cannot rotate relative to one another. The bolt 18 is fixedly connected to the bearing support 3 so that it cannot rotate relative to the bearing support 3. The planet support 16 is thus also fixedly connected to the bearing support 3 so that it cannot rotate relative to the bearing support 3. The rope drum 2 has at its circumference in the area of the planet wheels 14 a toothing 17 and the planet wheels 14 mesh with the toothing 17. The rotation of the sun wheel 13 causes the planet wheels 14 to rotate about the bearing axle 15, respectively. Since the bearing axles 15 are stationarily arranged, the rotation of the planet wheels 14 drives in rotation the rope drum 2.

In FIG. 2, the design of the bolt 18 is shown in more detail. The bolt 18 has at its end projecting into the interior 6 of the rope drum 2 a toothing 20 that interacts with the inner toothing 22 of the planet support 16. By means of the toothings 20 and 22, the bolt 18 and the planet support 16 are fixedly connected to one another so as not to rotate relative to one another.

For a fixed connection to the bearing support 3, the bolt 18 has in the area of the collar 32 a toothing 21 that interacts with a matching toothing of the bearing support 3. Between the toothings 20 and 21, the bolt 18 has a circumferential groove 24. The bottom of the circumferential groove 24 provides the smallest cross-section of the bolt 18. At the bottom of the groove 24 there are four wire strain gauges 25 that are schematically shown in FIG. 2. Two of the wire strain gauges are positioned at an angle of 90 degrees relative to one another. The two pairs of wire strain gauges are arranged on the circumference of the bolt 18 opposite one another in the circumferential groove 24. The bolt 18 has a passage 28 that, in the illustrated embodiment, is comprised of a longitudinal bore and a transverse bore in the bolt 18; these bores connect the circumferential groove 24 with the end of the bolt 18 projecting from the rope winch 1. Through the passage 28 a connecting line 26 of the wire strain gauges 25 is guided. The connecting line 26 connects the wire strain gauges 25 to a control 27 that is arranged outside of the rope winch 1.

The outwardly projecting end of the bolt 18 has a larger diameter resting against the shoulder 33 of the bearing support 3. In the area of the outwardly projecting end of the bolt 18, securing means in the form of a securing ring 23 are arranged that secure the bolt 18 in the direction of the drive axis 30. The diameter of the bolt 18 is greatest in the area of its outwardly projecting end. In the area of the toothing 21 the diameter is somewhat smaller and becomes even smaller in the area of the toothing 20. In this way, the bolt 18 can be pulled out of the rope winch 1 from the exterior side 31 of the bearing support 3 facing away from the rope drum 2 after the securing ring 23 has been removed. The securing ring 23 is accessible from the exterior so that dismounting of the bolt 18 is possible in a simple way.

It is also possible to provide other sensors for detecting load. The toothings 20, 21, 22 are configured in particular as serrations. It is also possible to employ other kinds of toothings that allow to pull the bolt 18 out from the rope winch 1.

The specification incorporates by reference the entire disclosure of European priority document 06 018 165.8 having a filing date of 31 Aug. 2006.

While specific embodiments of the invention have been shown and described in detail to illustrate the inventive principles, it will be understood that the invention may be embodied otherwise without departing from such principles.

What is claimed is:

1. A rope winch comprising:

at least one bearing support;

a rope drum supported on the at least one bearing support so as to be rotatable about a drive axis;

a drive motor and a gear connected to the drive motor, wherein the drive motor drives the rope drum about the drive axis through the gear;

at least one sensor that senses a load acting on the rope drum;

an exchangeably secured component that is exchangeable without dismounting the at least one bearing support, wherein the at least one sensor is arranged on the exchangeably secured component;

wherein the gear is supported on the exchangeably secured component that is interposed between the gear and the at least one bearing support and supported on the at least one bearing support.

2. The rope winch according to claim 1, wherein the at least one sensor has a connecting line for connecting the at least one sensor to a control, wherein the exchangeably secured component has a passage and the connecting line extends through the passage to the exterior of the rope winch.

3. The rope winch according to claim 1, comprising securing means that secure the exchangeably secured component on the at least one bearing support, wherein the securing means are accessible from a side of the at least one bearing support facing away from the rope drum.

4. The rope winch according to claim 1, wherein the exchangeably secured component is comprised of a material that is different from a material from which the at least one bearing support is made.

5. The rope winch according to claim 1, wherein the at least one bearing support is made from cast material.

6. The rope winch according to claim 1, wherein the at least one bearing support is made from gray cast iron.

7. The rope winch according to claim 1, wherein two of the at least one bearing support are provided and the rope drum has two ends and the two ends are supported on said two bearing supports.

8. The rope winch according to claim 7, wherein the drive motor is supported on a first one of said two bearing supports and the gear is supported on a second one of said two bearing supports.

9. The rope winch according to claim 1, wherein the exchangeably secured component is fixedly connected to the at least one bearing support to prevent relative rotation between the exchangeably secured component and the at least one bearing support and to allow movement of the exchangeably secured component relative to the at least one bearing support in a direction of the drive axis of the rope drum.

10. The rope winch according to claim 1, wherein the exchangeably secured component has a circumferential groove in which the at least one sensor is arranged.

11. The rope winch according to claim 10, wherein the exchangeably secured component has a first section and a second section, wherein the first section is fixedly connected to the at least one bearing support to prevent rotation between the first section and the least one bearing support and the second section is fixedly connected to a stationary planet support of the gear to prevent rotation between the second section and the stationary planet support, wherein the circumferential groove is arranged between the first and second sections.

12. A rope winch comprising:

at least one bearing support;

a rope drum supported on the at least one bearing support so as to be rotatable about a drive axis;

a drive motor and a gear connected to the drive motor, wherein the drive motor drives the rope drum about the drive axis through the gear;

at least one sensor that senses a load acting on the rope drum;

an exchangeably secured component that is exchangeable without dismounting the at least one bearing support, wherein the at least one sensor is arranged on the exchangeably secured component;

wherein the exchangeably secured component penetrates the at least one bearing support.

13. A rope winch comprising:

at least one bearing support;

a rope drum supported on the at least one bearing support so as to be rotatable about a drive axis;

a drive motor and a gear connected to the drive motor, wherein the drive motor drives the rope drum about the drive axis through the gear;

at least one sensor that senses a load acting on the rope drum;

an exchangeably secured component that is exchangeable without dismounting the at least one bearing support, wherein the at least one sensor is arranged on the exchangeably secured component;

wherein the exchangeably secured component is a bolt.

14. A rope winch comprising:

at least one bearing support;

a rope drum supported on the at least one bearing support so as to be rotatable about a drive axis;

a drive motor and a gear connected to the drive motor, wherein the drive motor drives the rope drum about the drive axis through the gear;

at least one sensor that senses a load acting on the rope drum;

an exchangeably secured component that is exchangeable without dismounting the at least one bearing support, wherein the at least one sensor is arranged on the exchangeably secured component;

wherein the gear is a planetary gear comprising planet wheels and a stationary planet support, wherein the planet wheels are supported on the stationary planet support.

15. The rope winch according to claim 14, wherein the stationary planet support is fixedly connected to the exchangeably secured component to prevent relative rotation between the stationary planet support and the exchangeably secured component and to allow movement of the exchangeably secured component relative to the stationary planet support in a direction of the drive axis of the rope drum.

16. The rope winch according to claim 15, wherein the stationary planet support and the exchangeably secured component are connected by a toothing.

17. The rope winch according to claim 15, wherein the stationary planet support and the exchangeably secured component are connected by a serration.

18. A rope winch comprising:

at least one bearing support;

a rope drum supported on the at least one bearing support so as to be rotatable about a drive axis;

a drive motor and a gear connected to the drive motor, wherein the drive motor drives the rope drum about the drive axis through the gear;

at least one sensor that senses a load acting on the rope drum;

an exchangeably secured component that is exchangeable without dismounting the at least one bearing support, wherein the at least one sensor is arranged on the exchangeably secured component;

wherein the at least one sensor is a wire strain gauge.

* * * * *